US011448474B2

(12) United States Patent
Liu et al.

(10) Patent No.: US 11,448,474 B2
(45) Date of Patent: Sep. 20, 2022

(54) PROTECTION STRUCTURE FOR VAPOR CHAMBER

(71) Applicant: ASIA VITAL COMPONENTS CO., LTD., New Taipei (TW)

(72) Inventors: Han-Min Liu, New Taipei (TW); Jian Zhang, New Taipei (TW); Xiao-Xiang Zhou, New Taipei (TW)

(73) Assignee: Asia Vital Components Co., Ltd., New Taipei (TW)

( * ) Notice: Subject to any disclaimer, the term of this patent is extended or adjusted under 35 U.S.C. 154(b) by 0 days.

(21) Appl. No.: 17/069,865

(22) Filed: Oct. 14, 2020

(65) Prior Publication Data

US 2021/0071969 A1 Mar. 11, 2021

Related U.S. Application Data

(62) Division of application No. 15/842,851, filed on Dec. 14, 2017, now abandoned.

(51) Int. Cl.

| | |
|---|---|
| ***F28D 15/02*** | (2006.01) |
| ***F28F 19/00*** | (2006.01) |
| ***F28F 3/12*** | (2006.01) |

(52) U.S. Cl.

CPC ..... *F28F 19/002* (2013.01); *F28D 15/0233* (2013.01); *F28D 15/0275* (2013.01); *F28D 15/0283* (2013.01); *F28F 3/12* (2013.01); *F28F 2225/00* (2013.01); *F28F 2225/04* (2013.01); *F28F 2275/025* (2013.01);

(Continued)

(58) Field of Classification Search

CPC ... F28D 15/02; F28D 15/0283; F28D 15/0233

See application file for complete search history.

(56) References Cited

U.S. PATENT DOCUMENTS

| | | | | |
|---|---|---|---|---|
| 6,276,444 | B1 * | 8/2001 | Li | F28D 15/0283 165/104.21 |
| 2012/0080170 | A1 * | 4/2012 | Yang | F28D 15/0283 165/104.26 |
| 2013/0153175 | A1 | 6/2013 | Lin | |

FOREIGN PATENT DOCUMENTS

| | | |
|---|---|---|
| CN | 2618300 Y | 5/2004 |
| CN | 2938719 Y | 8/2007 |

(Continued)

OTHER PUBLICATIONS

Search Report dated May 7, 2018 issued by Taiwan Intellectual Property Office for counterpart application No. 106140957.

(Continued)

*Primary Examiner* — Eric S Ruppert

(74) *Attorney, Agent, or Firm* — Demian K. Jackson; Jackson IPG PLLC

(57) ABSTRACT

A protection element for vapor chamber includes a main body and a protection element. The main body is divided into a working zone and a sealing zone. The sealing zone is located around an outer periphery of the working zone and is provided with a notch area, to which a fluid-adding and air-evacuating pipe is connected. The protection element is correspondingly mounted to the notch area to contact with the sealing zone of the main body. With the arrangement of the protection element, the fluid-adding and air-evacuating pipe is protected against collision and impact and accordingly, the main body of the vapor chamber is protected against vacuum and working fluid leakage.

5 Claims, 8 Drawing Sheets

(52) U.S. Cl.
CPC ..... *F28F 2275/06* (2013.01); *F28F 2275/085* (2013.01); *F28F 2275/10* (2013.01)

(56) References Cited

FOREIGN PATENT DOCUMENTS

| | | | | | |
|---|---|---|---|---|---|
| CN | 201653234 | U | | 11/2010 | |
| CN | 204678941 | U | | 9/2015 | |
| CN | 207487476 | U | | 6/2018 | |
| JP | 62245087 | A | * | 10/1987 | ..... F28D 15/0283 |
| TW | M355546 | U | | 4/2009 | |
| TW | M381775 | U | | 6/2010 | |
| TW | M385910 | U | | 8/2010 | |
| TW | M556839 | U | | 3/2018 | |

OTHER PUBLICATIONS

Search Report dated Feb. 22, 2019 issued by China National Intellectual Property Administration for counterpart application No. 2017112433182.

* cited by examiner

PROTECTION STRUCTURE FOR VAPOR CHAMBER

The present application is a division of U.S. patent application Ser. No. 15/842,851, filed on Dec. 14, 2017.

FIELD OF THE INVENTION

The present invention relates to a protection structure for vapor chamber, and more particularly, to a protection structure for protecting a fluid-adding and air-evacuating pipe structure provided on a vapor chamber.

BACKGROUND OF THE INVENTION

A vapor chamber is a very popular heat dissipation element. Conventionally, the vapor chamber is formed of an upper plate member and a lower plate member, which are closed to each other to define a sealed chamber in between them. In the sealed chamber, a wick structure and a working fluid are provided and air is evacuated to complete the manufacturing of the vapor chamber.

Please refer to FIGS. 1*a*, 1*b* and 2, which show some conventional vapor chambers 5. As shown, to facilitate the adding of the working fluid into the sealed chamber and the evacuating of air from the sealed chamber, a conventional vapor chamber 5 is usually provided with a pipe 6, which is communicable with the sealed chamber of the vapor chamber 5. Finally, an outer end of the pipe 6 is sealed to keep the vapor chamber 5 in a vacuum-tight state. Since the pipe 6 is protruded beyond an outer configuration of the vapor chamber 5, it is subjected to collision, breaking and damage during transporting or assembling the vapor chamber 5 to result in leakage of vacuum and working fluid from the sealed chamber. To overcome this problem, there are provided a first conventional vapor chamber 5 having one of its four corners being chamfered, as shown in FIG. 1*a*, and a second conventional vapor chamber 5 having one of its four edges being formed with a notch area 52, as shown in FIG. 1*b*, and the pipe 6 is provided at the chamfered corner 51 and the notch area 52, respectively, to reduce the possibility of impacting or damaging the protruded pipe 6. However, the chamfered corner 51 and the notch area 52 formed on the vapor chambers 5 do not provided good pipe protection effect.

There is also provided a third conventional vapor chamber 5 having a protection bar 53 transversely extended across the notch area 52, as shown in FIG. 2, so as to protect the pipe 6 against colliding, impacting and damage. For the protection bar 53 to provide effective protection to the pipe 6, the protection bar 53 must be additionally formed on one of the upper and the lower plate member 5*a*, 5*b* of the vapor chamber 5. This will inevitably and disadvantageously increase the processing procedures, the time and accordingly, the cost for manufacturing the vapor chamber 5.

Further, the provision of the protection bar 53 at the notch area 52 would form a hindrance that interferes with the working fluid adding and the air evacuation via the pipe 6, causing inconvenience to workers who handle these operations.

It is therefore tried by the inventor to develop an improved protection structure that protects the fluid-adding and air-evacuating pipe structure provided on a vapor chamber and eliminates the disadvantages in the conventional pipe protection structures for vapor chambers.

SUMMARY OF THE INVENTION

A primary object of the present invention is to provide a protection structure that can protect a fluid-adding and air-evacuating pipe structure provided on a vapor chamber, so as to solve the problems in the prior art vapor chamber.

To achieve the above and other objects, the protection structure for vapor chamber according to a preferred embodiment of the present invention includes a main body and a protection element.

The main body is divided into a working zone and a sealing zone. The sealing zone is located around an outer periphery of the working zone and is provided with a notch area, to which a fluid-adding and air-evacuating pipe is connected. The protection element is correspondingly mounted to the notch area to contact with the sealing zone of the main body.

According to the present invention, a protection element not integrally formed with a vapor chamber is used to protect a fluid-adding and air-evacuating pipe on the vapor chamber against collision and impact during transporting or installation of the vapor chamber, so as to avoid the occurrence of vacuum and working fluid leakage of the main body and to save a large amount of cost of manufacturing the vapor chamber. And, the arrangement of the protection element does not interfere with the use of the pipe to add working fluid and evacuate the air into and from the main body.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1A:
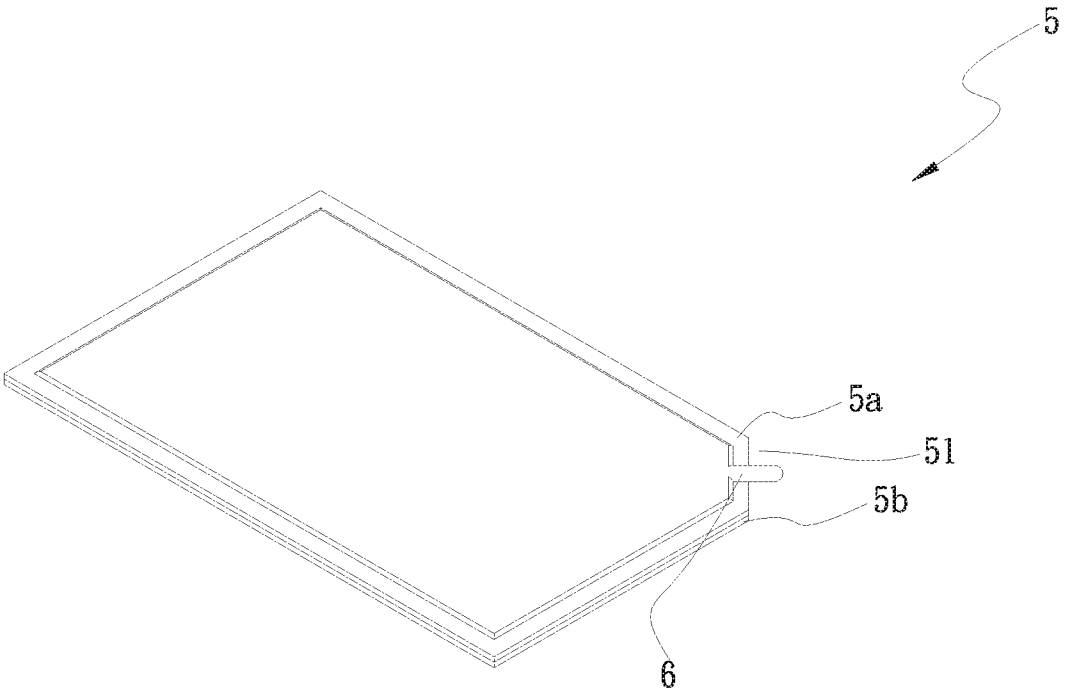
Fig. 1a(Prior art)
FIGS. 1*a* and 1*b* are perspective views of a first and a second conventional vapor chamber, respectively.
Figure 1B:
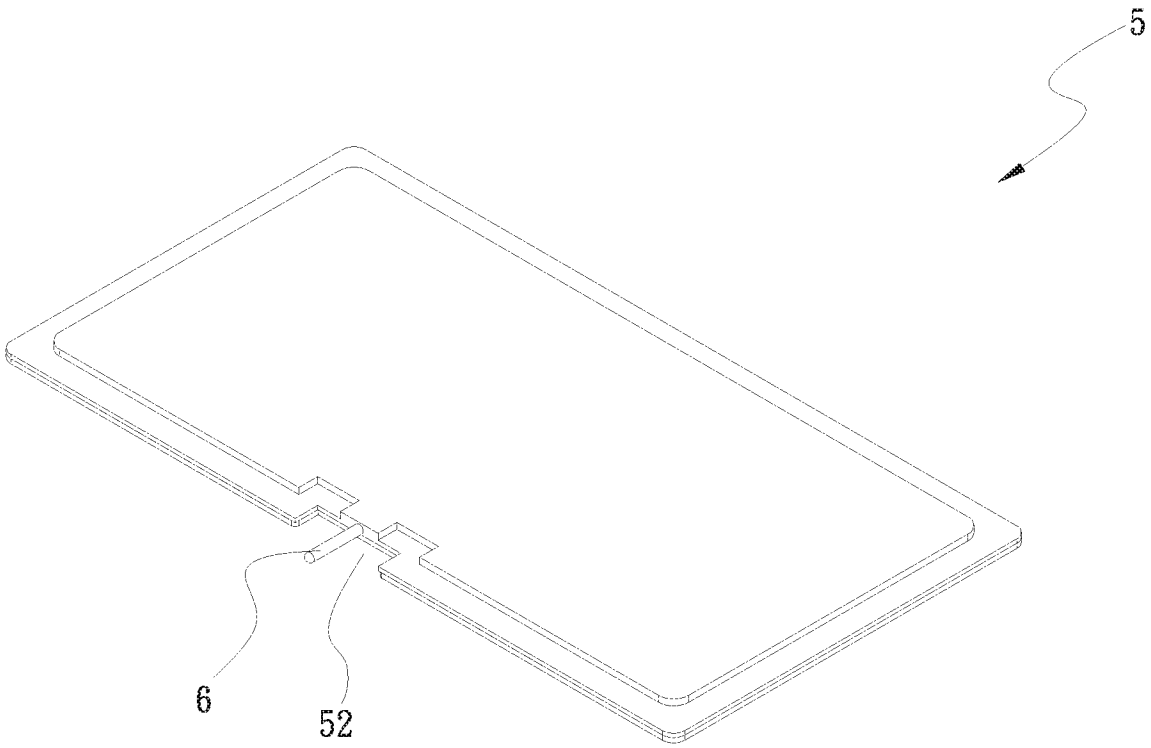
Fig. 1b(Prior art)
Figure 2:
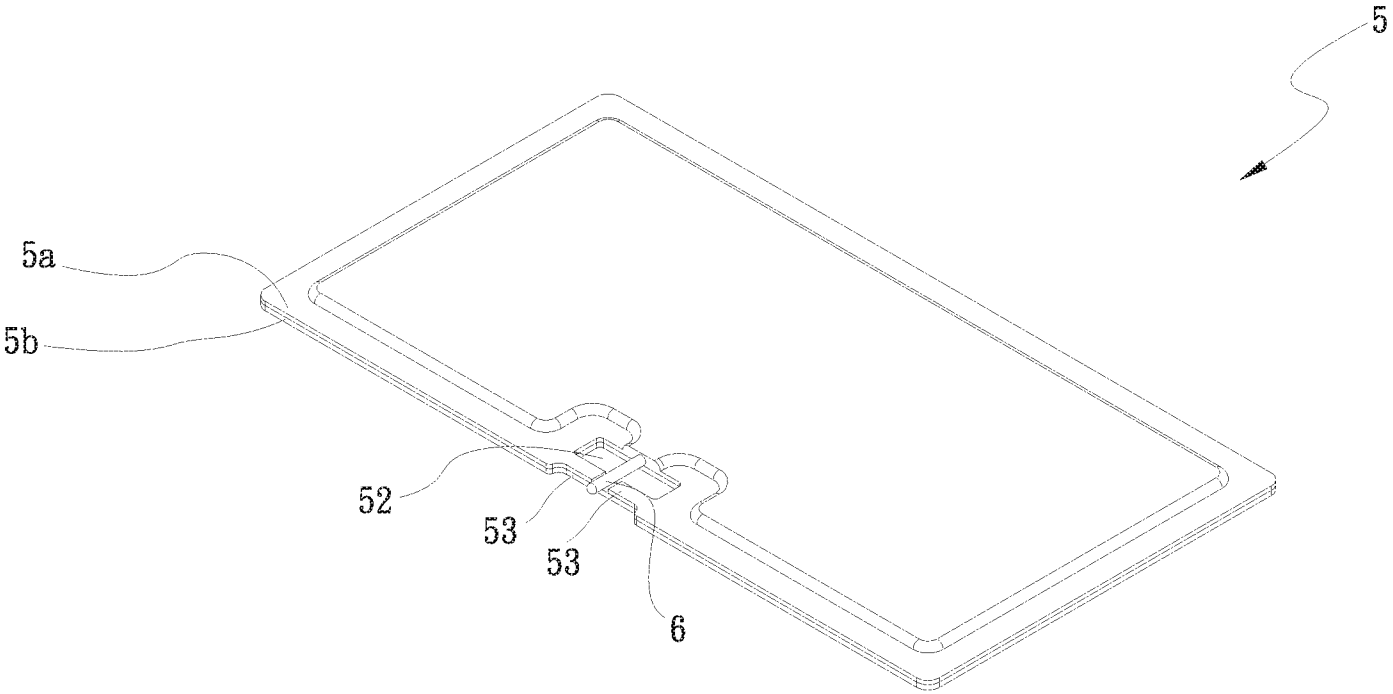
Fig. 2(Prior art)
FIG. 2 is a perspective view of a third conventional vapor chamber.

The present invention will now be described with some preferred embodiments thereof and by referring to the accompanying drawings. For the purpose of easy to understand, elements that are the same in the preferred embodiments are denoted by the same reference numerals.

Figure 3:
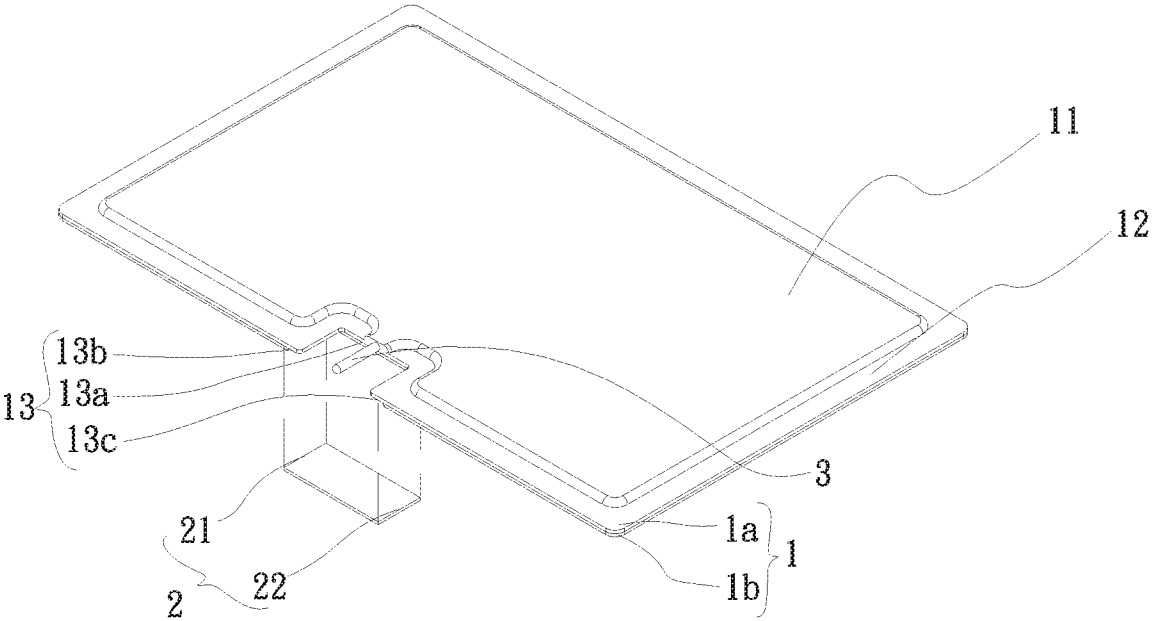
FIG. 3 is an exploded perspective view showing a protection structure for vapor chamber according to a first embodiment of the present invention.
Figure 4:
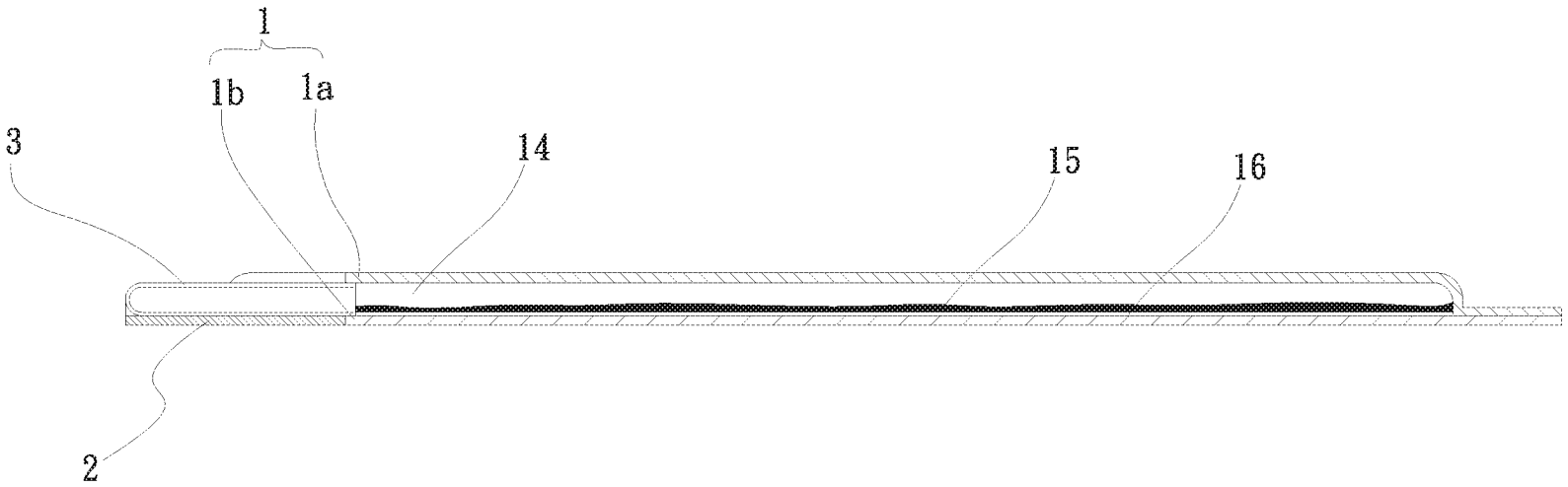
FIG. 4 is an assembled sectional view of the protection structure for vapor chamber according to the first embodiment of the present invention.

Please refer to FIGS. 3 and 4, which are exploded perspective view and assembled sectional view, respectively, of a protection structure for vapor chamber according to a first embodiment of the present invention. As shown, in the first embodiment, the protection structure for vapor chamber includes a main body 1 and a protection element 2.

The main body 1 is a vapor chamber, which is divided into a working zone 11 and a sealing zone 12. The sealing zone 12 is located around an outer periphery of the working zone 11 and is provided with a notch area 13, to which a pipe 3 for working fluid adding and air evacuation is connected. The main body 1 is formed by correspondingly closing an upper plate member 1*a* and a lower plate member 1*b* to each other, such that a sealed chamber 14 is defined in between the closed upper and lower plate members 1*a*, lb. In the sealed chamber 14, a wick structure 15, bosses or plated layers and a working fluid 16 are provided. The sealed chamber 14 is formed in the working zone 11, and the sealing zone 12 is located around outer edges of the sealed chamber 14. That is, the sealing zone 12 is an area at where the upper and lower plate members 1*a*, 1*b* are hermetically connected to each other. The pipe 3 is clamped to between the upper and the lower plate member 1*a*, 1*b* to form a part of the main body 1 and communicate with the sealed chamber 14. An outer end of the pipe 3 is a free end, which is sealed after the vapor chamber is completed.

The notch area 13 has a first side 13*a*, a second side 13*b* and a third side 13*c*. The second side 13*b* and the third side 13*c* are located at and connected to two opposite ends of the first side 13*a*; and the pipe 3 is extended through and connected to the first side 13*a*.

The protection element 2 is correspondingly mounted to the notch area 13 with at least one end of the protection element 2 being in contact with the sealing zone 12 of the main body 1. More specifically, the protection element 2 has a first end 21 and a second end 22, which are pressed against the second side 13*b* and the third side 13*c* of the notch area 13, respectively. In the illustrated first embodiment, the protection element 2 is connected to the main body 1 by pressing the first and the second end 21, 22 against the second and the third side 13*b*, 13*c* of the notch area 13, respectively. However, the protection element 2 can also be connected to the main body 1 by way of snap-fit, riveting, gluing, welding or tight-fit. The protection element 2 can be made of a copper material, an aluminum material, a nickel material, a pure titanium material, a stainless steel material, a polymeric material, or a ductile material.

Figure 5:
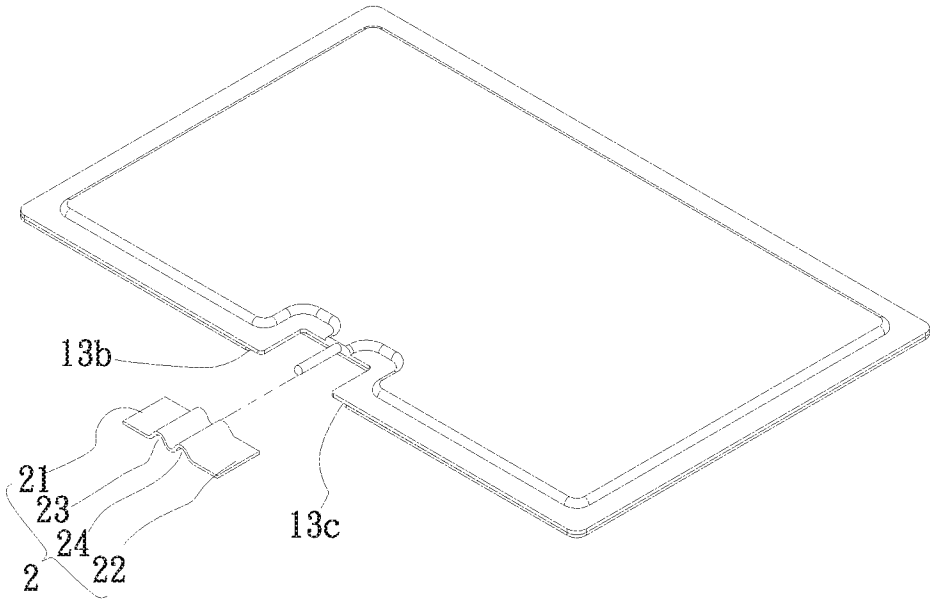
FIG. 5 is an exploded perspective view showing a protection structure for vapor chamber according to a second embodiment of the present invention.

Please refer to FIG. 5, which is an exploded perspective view showing a protection structure for vapor chamber according to a second embodiment of the present invention. The second embodiment is different from the first embodiment in that the protection element 2 in the second embodiment is provided with a plurality of recessed sections. There are two recessed sections, namely, a first recessed section 23 and a second recessed section 24, shown in FIG. 5. The first and the second recessed section 23, 24 are axially spaced from each other on the protection element 2, such that the protection element 2 is in the form of a corrugated plate. The pipe 3 is correspondingly seated between the first and the second recessed section 23, 24 when the first and the second end 21, 22 of the protection element 2 are respectively pressed against the second and the third side 13*b*, 13*c* of the notch area 13. With the first and second recessed sections 23, 24, the protection element 2 can have a certain degree of flexibility and elasticity, which allows the first and the second end 21, 22 of the protection element 2 to be tightly pressed against the second and the third side 13*b*, 13*c* of the notch area 13 and accordingly, stably held to the notch area 13. Since all other structural and functional features of the second embodiment are similar to those of the first embodiment, they are not repeatedly described herein.

Figure 6:
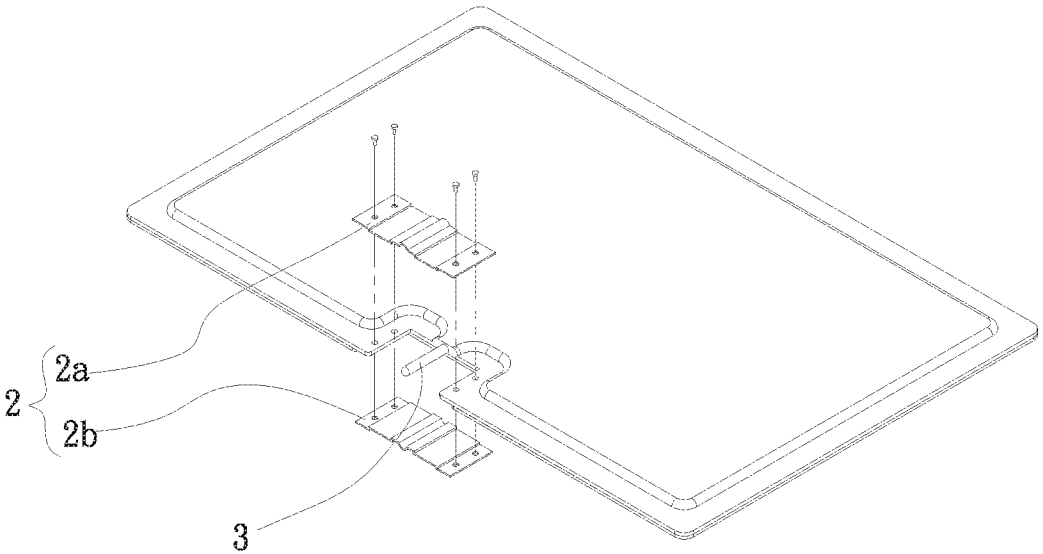
FIG. 6 is an exploded perspective view showing a protection structure for vapor chamber according to a third embodiment of the present invention.

Please refer to FIG. 6, which is an exploded perspective view showing a protection structure for vapor chamber according to a third embodiment of the present invention. The third embodiment is different from the first embodiment in that the protection element 2 in the third embodiment consists of a first plate 2*a* and a second plate 2*b*, which are assembled to superpose on each other and allow the pipe 3 to be fitted between them. The assembled and superposed first and second plate 2*a*, 2*b* are mounted to the notch area 13 on the main body 1 to protectively sandwich the pipe 3 between them. Since all other structural and functional features of the third embodiment are similar to those of the first embodiment, they are not repeatedly described herein.

Figure 7:
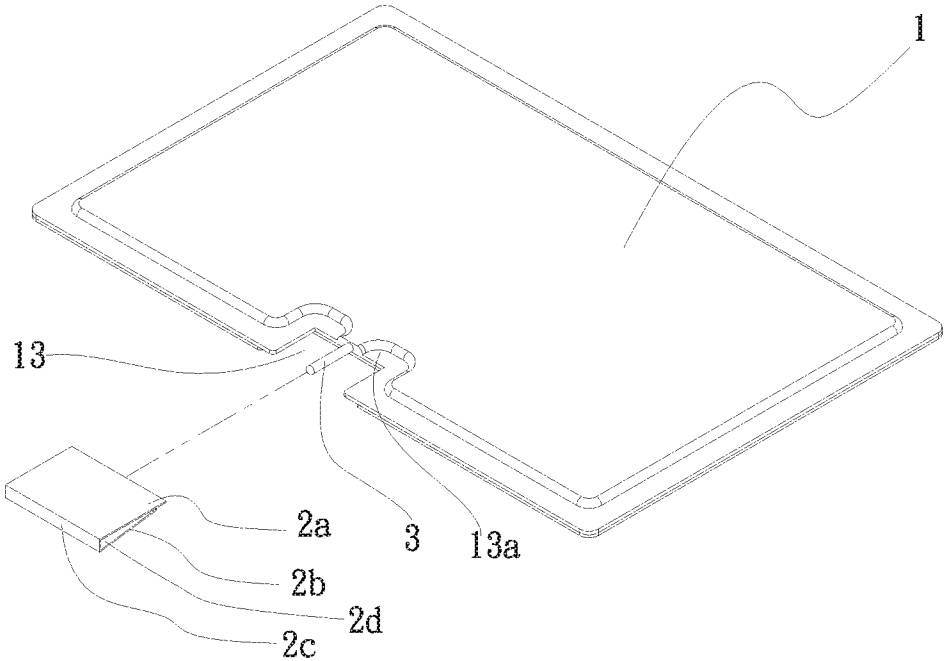
FIG. 7 is an exploded perspective view showing a protection structure for vapor chamber according to a fourth embodiment of the present invention.

Please refer to FIG. 7, which is an exploded perspective view showing a protection structure for vapor chamber according to a fourth embodiment of the present invention. The fourth embodiment is different from the first embodiment in that the protection element 2 in the fourth embodiment consists of a first plate 2*a*, a second plate 2*b* and a connection section 2*c*. The connection section 2*c* is connected at two opposite transverse edges to the first plate 2*a* and the second plate 2*b*, such that the first and second plates 2*a*, 2*b* and the connection section 2*c* together define a protection space 2*d* in between them. When the protection element 2 is mounted to the notch area 13, free ends of the first and second plates 2*a*, 2*b* opposite to the connection section 2*c* are fitly attached to the first side 13*a* of the notch area 13. Since the protection element 2 possesses some degree of elasticity, an external force can be applied thereto to space the first and the second plate 2*a*, 2*b* apart to facilitate easy attachment of the first and second plates 2*a*, 2*b* to the first side 13*a* of the notch area 13. After the protection element 2 has been properly mounted to the notch area 13, the external force is released for the first and second plates 2*a*, 2*b* to elastically return to their original shape and firmly clamp onto the first side 13*a*, while the second and third sides 13*b*, 13*c* of the notch area 13 and the pipe 3 are received in the protection space 2*d*. Since all other structural and functional features of the fourth embodiment are similar to those of the first embodiment, they are not repeatedly described herein.

In the above embodiments, the main body 1 and the protection element 2 are not integrally formed with each other, and the protection element 3 serves as a protection structure for the pipe 3. A main advantage of the above-described non-integrally formed protection structure for vapor chamber according to the present invention is to protect the pipe 3 against collision or impact during transporting or installation of the vapor chamber and accordingly, avoid the occurrence of vacuum and working fluid leakage of the main body 1. The present invention also advantageously saves a large amount of cost of manufacturing the vapor chamber and it does not interfere with the use of the pipe 3 to add the working fluid and evacuate the air into and from the main body 1 during the manufacturing process of the vapor chamber.

Further, compared to the conventional integrally formed protection structures for vapor chamber that require a relatively higher manufacturing cost and a plurality of molds and dies, the non-integrally formed protection structure for vapor chamber according to the present invention can save the mold and die design cost and can therefore be manufactured at a relatively lower cost.

The present invention has been described with some preferred embodiments thereof and it is understood that many changes and modifications in the described embodiments can be carried out without departing from the scope and the spirit of the invention that is intended to be limited only by the appended claims.

What is claimed is:

1. A vapor chamber having a protection structure comprising:

a main body divided into a working zone and a sealing zone located around an outer periphery of the working zone and provided with a notch area having a first side, a second side, and a third side;

a pipe configured for addition of working fluid and air evacuation connected to the notch area; and a protection element correspondingly mounted to the notch area to contact with the sealing zone of the main body, the protection element comprising a first plate, a second plate, and a connection section connected at two opposite transverse edges to the first and the second plate, such that the first and second plates and the connection section together form a triangular structure to provide a clamping force and define a protection space in between them, the protection space covering the second side and third side of the notch area and the pipe; wherein free ends of the first and second plates clip to the first side of the notch area, and wherein the protection element is configured to be removed from the notch through the application of an external force.

2. The vapor chamber having the protection structure of claim 1, wherein the working zone of the main body internally defines a sealed chamber in fluid communication with the pipe.

3. The vapor chamber having the protection structure of claim 1, wherein the protection element and the main body are not integrally formed with each other.

4. The vapor chamber having the protection structure of claim 1, wherein the protection element is made of a material selected from the group consisting of a copper material, an aluminum material, a nickel material, a pure titanium material, a stainless steel material, a polymeric material, and a ductile material.

5. The vapor chamber having the protection structure of claim 1, wherein the sealing zone completely encircles the outer periphery of the working zone.

* * * * *